US005540005A

United States Patent [19]

Lynch

[11] Patent Number: 5,540,005

[45] Date of Patent: Jul. 30, 1996

[54] CONTAMINATED MARINE SEDIMENTS DREDGING APPARATUS

[76] Inventor: Robert P. Lynch, 10177 S. 77th East Ave., Tulsa, Okla. 74133

[21] Appl. No.: 505,777

[22] Filed: Jul. 21, 1995

[51] Int. Cl.[6] ..... E02F 3/34; E02F 3/47

[52] U.S. Cl. ..... 37/340; 37/187; 294/68.23

[58] Field of Search ..... 37/309, 339, 340, 37/341, 342, 343, 344, 3, 187, 901, 461; 294/68.23, 88; 56/400.12

[56] References Cited

U.S. PATENT DOCUMENTS

| | | | |
|---|---|---|---|
| 2,828,038 | 3/1958 | Dorkirs | 37/187 X |
| 3,693,274 | 9/1972 | Piccagli | 37/340 X |
| 4,092,790 | 6/1978 | Sonerud | 37/340 |
| 4,116,069 | 9/1978 | Lezgintsev et al. | 37/340 X |
| 4,143,900 | 3/1979 | Longo | 37/187 X |
| 4,373,278 | 2/1983 | Myrick | 37/340 |
| 4,631,844 | 12/1986 | Deal | 37/341 X |
| 4,882,859 | 11/1989 | Bollingen | 37/187 |
| 4,908,966 | 3/1990 | Phillips et al. | 37/340 |
| 5,199,194 | 4/1993 | Scott | 37/187 X |

OTHER PUBLICATIONS

Cable Arm Clamshell. Advertisement attached. (1994, no month).

Proprietary clamshell dredge. Dow Environmental, Inc. p. 15, Statement of Qualifications attached. May 1992.

*Primary Examiner*—Terry Lee Melius
*Assistant Examiner*—Robert Pezzuto

[57] ABSTRACT

A marine dredging device comprised of scoop buckets hinge-connected to a soil receiver chamber with deployable silt curtains. The silt curtains are deployed to close off the aperture between the scoop buckets and prevent the extrusion of soil. Introduction of pressurized air lowers the water level in the soil receiver chamber to provide a void for dredged soil.

16 Claims, 7 Drawing Sheets

CONTAMINATED MARINE SEDIMENTS DREDGING APPARATUS

BACKGROUND OF THE INVENTION

1. Field of the Invention

This invention relates to the field of marine dredging.

2. Description of the Related Art

An apparatus identified by the trade name "Cable Arm Clamshell" is advertised as an environmental dredging device by Cable Arm Incorporated of Trenton, Mich. Their literature states that a patent is pending. This cable operated device differs from a conventional grab type of dredge commonly known as a "clamshell bucket" in that it is less prone to spill excess soil due to the buckets forming a nominally closed compartment when the buckets are in the fully closed position.

My invention differs from the Cable Arm apparatus in several aspects. My apparatus provides a soil receiver chamber with an air-void so that water does not have to be displaced from the dredge by the incoming soil. Water must flow out of the Cable Arm apparatus in a volume equal to the dredged soil. My apparatus has its scoop buckets hinged to a soil receiver chamber whereas the Cable Arm apparatus has its scoop buckets hinged to each other as is done with a conventional clamshell dredge. Furthermore, the Cable Arm apparatus does not provide deployable silt curtains. In addition, the Cable Arm apparatus does not provide means of jet water washing the interior of the buckets.

A proprietary clamshell dredge is depicted in promotional literature provided by Dow Environmental Incorporated of Rockville, Md. This apparatus appears to be a conventional clamshell bucket with additional metal plating added to the sides and tops of the buckets to provide a nominally closed compartment when said buckets are in the fully closed position. The company's literature makes no claim of patents issued or pending.

My invention differs from the Dow Environmental apparatus in several aspects. Again, my apparatus provides a soil receiver chamber with an air-void so that water does not have to be displaced from the dredge by the incoming soil and the Dow device has no such feature. Furthermore, the Dow apparatus does not provide deployable silt curtains. In addition, the Dow apparatus does not provide means of jet water washing the interior of the buckets.

BACKGROUND

The present invention relates to an apparatus and method suitable for dredging contaminated marine sediments.

In the early days of the industrial era, commercial enterprises were often located on waterways for the convenience, of disposing contaminated materials necessary to the manufacture of their products. In recent years, society has come to acknowledge that these contaminants pose a hazard to marine life and ultimately to human life. Consequently, society has now determined that these marine contaminants should be removed from the bodies of water where they lie.

Removal of contaminated marine sediments presents a problem that is not addressed by current dredging technology. It is crucial that the dredging process not spread the contamination to adjacent clean waters. Most water environments have prevailing currents. If a dredging operation causes the suspension of fine soil particles that are contaminated, the current can transport these particles a considerable distance thus spreading the contamination over a broader area and further compounding the problem.

Historically, the primary objective of any dredging technique has been production efficiency. Stirring up the bottom of the water-body has been of little or no concern. Contaminated sediment dredging requires that particle re-suspension take precedence over production maximization.

Water that has come in contact with dredged soil becomes contaminated. Some conventional dredging processes such as hydraulic dredging produce a large volume of associated water which is usually directed to a settling pond and returned to the water-body after the soil has settled. When the soil contains contaminated sediments, the associated water must be treated using a remediation process before it can be allowed back into the water-body. This requirement increases the degree of difficulty and cost of a project.

Conventional "grab type" dredging techniques such as "clamshell bucket" or "drag line bucket" are designed to operate without concern for excess soil spilling out of the buckets during operation. In order to maximize operating efficiency, these buckets are normally over-filled. These dredging techniques commonly produce a flume of water-borne sediments that are widely dispersed by the prevailing currents. Thus, the conventional grab type dredges are not well suited for the retrieval of contaminated marine sediments.

It can be appreciated that a preferred means of dredging contaminated marine sediments would be one that totally captures and contains all of the soil and sediments brought into the apparatus. A preferred process would not allow contaminated water to be displaced from the apparatus during the operation. The invention described hereunder is a dredging device and process that accomplishes these objectives.

SUMMARY OF THE INVENTION

It is an object of this invention to provide a dredging apparatus that minimizes the re-suspension of contaminated marine sediments during operation of the system.

It is a further objective of this invention to describe a method of operating the apparatus that minimizes the re-suspension of contaminated marine sediments.

In a broad sense this invention is a dredging apparatus that incorporates an air-void chamber to receive dredged soil without an attendant displacement of water and a deployable silt curtain system that prevents the escape of sediments disturbed during the operation of the apparatus.

My invention is primarily comprised of a soil receiver chamber, scoop buckets and deployable silt curtains. The scoop buckets are hinge connected to the soil receiver and are actuated by hydraulic linear actuators which are pin connected to the soil receiver and buckets.

When the scoop buckets are in the full open position their cutting surfaces are nominally vertical to the plane of the soil. Thus, when the dredging apparatus is lowered into the soil, a minimum of penetration resistance is developed. Actuation of the hydraulic linear actuators causes the buckets to close and capture a "bite" of soil.

It can be appreciated that during closure of the scoop buckets, disturbed soil would tend to be extruded out of the aperture between the bucket side plates. The objective of the silt curtain system is to close off this aperture and thus eliminate the possibility of disturbed soil flowing out of the apparatus.

The silt curtains translate vertically and are operated by hydraulic linear actuators which are interconnected to the soil receiver and the silt curtains. Prior to lowering the dredging apparatus into the soil, the silt curtains are positioned in their fully retracted position. They remain in this position until the dredging apparatus has been lowered to the full cut depth. Then the silt curtains are lowered by operating the hydraulic linear actuators. The silt curtains are differentially deployable and are mounted on guide members that ride on rollers which are mounted on the soil receiver chamber. The silt curtains also slide on the side surfaces of the soil receiver and scoop buckets and form a seal. The silt curtains are differentially deployed independent of each other so as to accommodate different soil depths on either side of the apparatus. This is a necessary feature because one side of the apparatus may be encountering virgin soil while the other is operating in loose soil or the void made by the previous cut. Thus the independent operation of the system allows each silt curtain to seat to the appropriate depth. Hydraulic accumulators are provided in the control circuitry so that the silt curtains may deploy to their full depth as the dredging apparatus is being extracted from the soil thus sealing the seams of the buckets.

The soil receiver chamber is a box structure with an open bottom. The scoop buckets are hinged connected to opposing lower edges of the soil receiver chamber. An air inlet/outlet port is provided in the top of the soil receiver. Pressurized air is supplied to the inlet port via a hose from an air compressor. Sufficient air is supplied to lower the air/water interface within the soil receiver nominally to the hinge line or approximately thereabouts. This air-void provides space for the "bite" of soil captured by the dredging apparatus. It can be appreciated that if this space were not provided, a volume of water equal to the volume of soil captured would be expelled from the apparatus by the soil. It can be further appreciated that any expelled water would be contaminated by the disturbed sediments and thus would spread the contamination. The air vent valve is opened as the scoop buckets are being closed thus reducing the pressure within the dredging apparatus to a value nominally less than the ambient water pressure. It can be appreciated that the negative pressure differential will result in water entering the dredging apparatus rather than the opposite, thus any leakage through the silt curtains will be contained. The size of the vent opening is adjusted for the water depth so that the air is released in a controlled manner.

A pipe manifold with water jet nozzles is provided in the soil receiver chamber. A hose supplies water from a pump to the pipe manifold. The jet nozzles are positioned so as to direct water to the interior surfaces of the soil receiver chamber and scoop buckets so as to wash out adhesive soils.

My invention can be employed using a "vessel of opportunity" such as a barge with a suitable handling system. The handling system can be a boom type crane or a modified hydraulic excavating machine commonly referred to as a "backhoe".

When using a boom crane, the dredging apparatus is suspended from the load line and lowered to the bottom with the scoop buckets in the full open position and the silt curtains in the fully retracted position. Compressed air is supplied to the dredging apparatus as it is being lowered. Upon reaching the proximity of the water body floor or "bottom", the lowering is halted to allow the air/water interface to reach the desired level in the soil receiver chamber. The dredging apparatus is then lowered into the bottom to the desired depth of penetration. The silt curtains are then lowered to their point of penetration resistance. The scoop buckets are then closed to take a bite of soil. The dredging apparatus is then retrieved from the water and positioned over the vessel or container provided to receive the soil. If the soil is of an adhesive nature, the water jet system is operated to wash and remove the soil from the dredging apparatus. The process is then repeated.

When using a hydraulic backhoe, an adaptor may be fabricated to attach the dredging apparatus to the outer boom. The working process then becomes similar to the aforementioned procedure with the exception that the dredging apparatus may be forced further into the soil by using downward thrust provided by the backhoe.

While the preferred embodiment and use of this dredging apparatus lies in dredging contaminated marine sediments, it may also be used for conventional dredging. The silt curtains offer an increase in operating efficiency in that they eliminate the extrusion of soil out of the aperture between the scoop bucket edges during closure and thus resulting in a greater amount of soil retrieved per cycle. This aspect also results in a more even bottom surface which also enhances the efficiency of operation.

It can be appreciated that this dredging apparatus offers an improved means of retrieving contaminated marine sediments that has obvious advantages over conventional dredging apparatus and techniques. Therefore, my dredging apparatus offers society an economical means heretofore unavailable of cleaning contaminated water-bodies without spreading the contamination.

The objectives are meant to be illustrative and are not limiting. The manner of operation, novel features and further objectives and advantages of my invention may be better understood by reference to the following description and drawings.

LIST OF REFERENCE NUMERALS

Figure 1:
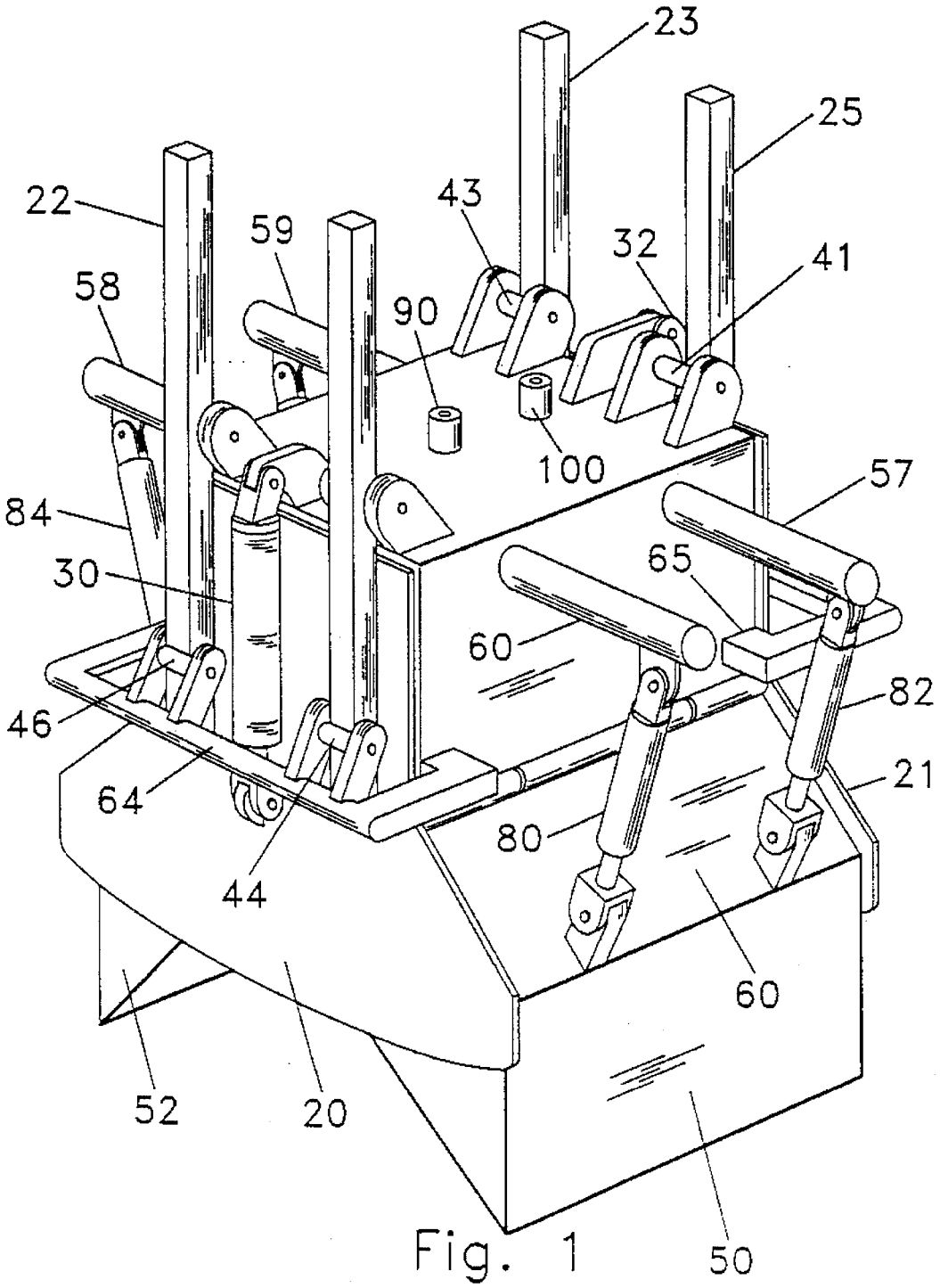
FIG. 1 is a prospective view of the dredging apparatus with the scoop buckets open and the silt curtains retracted.

20 silt curtain plate
21 silt curtain plate
22 silt curtain plate guide member
23 silt curtain plate guide member
24 silt curtain plate guide member
25 silt curtain plate guide member
30 silt curtain deployment hydraulic linear actuator
32 silt curtain deployment hydraulic linear actuator
40 roller
41 roller
42 roller
43 roller
44 roller
45 roller
46 roller
47 roller
56 actuator support member

57 actuator support member
58 actuator support member
59 actuator support member
60 soil receiver chamber
80 scoop bucket closure hydraulic linear actuator
82 scoop bucket closure hydraulic linear actuator
84 scoop bucket closure hydraulic linear actuator
86 scoop bucket closure hydraulic linear actuator
90 jet water supply hose connection fitting
91 jet water manifold
92 jet water nozzle
93 jet water nozzle
94 jet water nozzle
95 jet water nozzle
97 jet water nozzle
98 jet water nozzle
99 jet water nozzle
100 air supply hose connection fitting.
102 air compressor
104 pneumatic operated air vent valve
106 pneumatic operated air supply valve
108 solenoid operated air control valve—vent
109 solenoid operated air control valve—pressure
112 water pump
114 manual control valve—water
120 hydraulic pump
122 hydraulic reservoir
124 hydraulic accumulator
125 hydraulic accumulator
126 solenoid operated hydraulic control valve
127 solenoid operated hydraulic control valve
128 solenoid operated hydraulic control valve
129 solenoid operated hydraulic control valve
130 water hose
131 air hose
132 hydraulic return hose
133 hydraulic supply hose
134 hydraulic return hose
135 hydraulic supply hose
136 hydraulic return hose
137 hydraulic supply hose
140 hydraulic pressure gage
142 hydraulic pressure gage
144 hydraulic pressure gage

DETAILED DESCRIPTION OF THE PREFERRED EMBODIMENT

FIG. 1 illustrates the dredging apparatus in perspective view. As seen in FIG. 1, scoop buckets 52 and 50 are in the open position and silt curtains 20 and 21 are in the retracted position.

Figure 2:
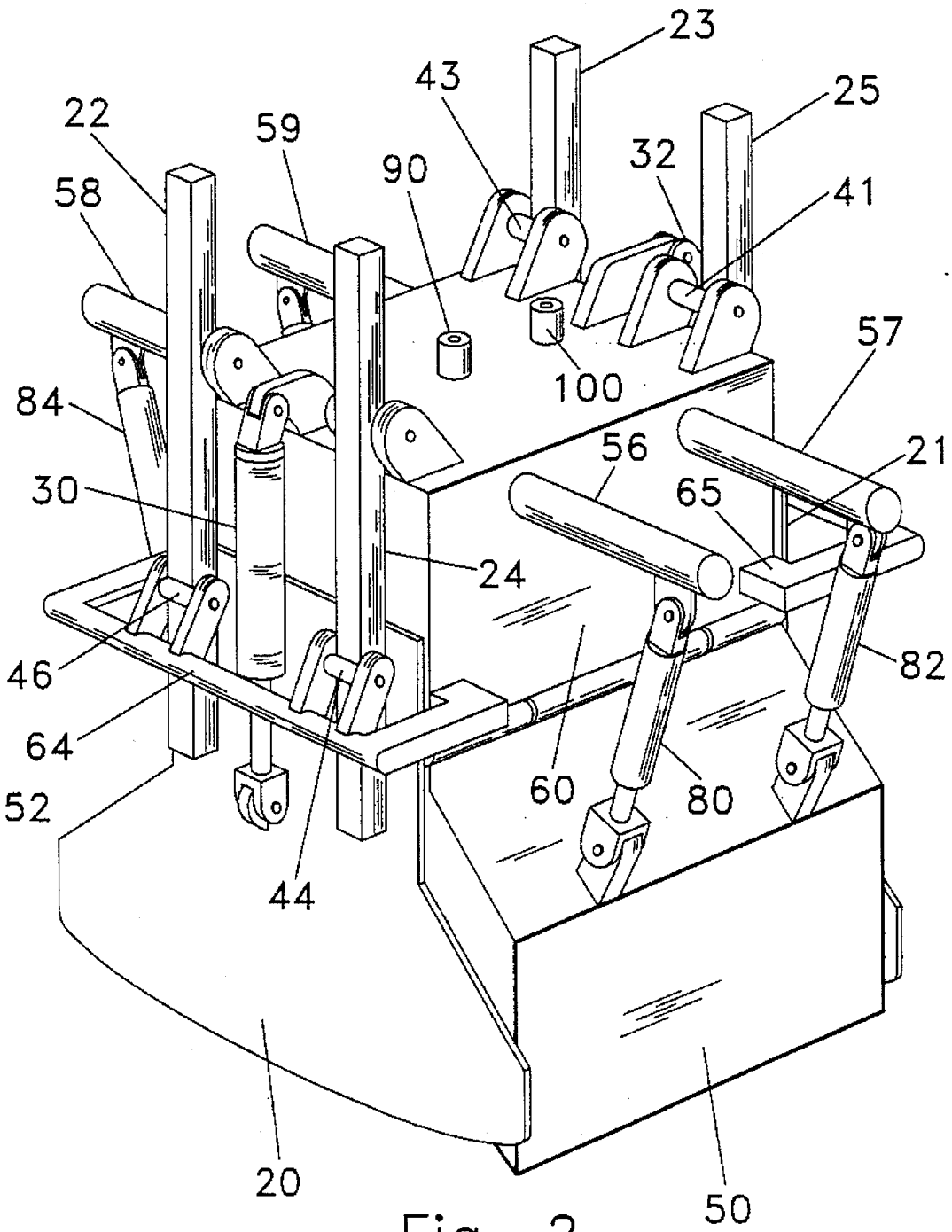
FIG. 2 is a prospective view of the dredging apparatus with the scoop buckets open and the silt curtains deployed.

FIG. 2 illustrates the dredging apparatus in perspective view. As seen in FIG. 2, scoop buckets 52 and 50 are in the open position and silt curtains 20 and 21 are in the fully deployed position.

Figure 3:
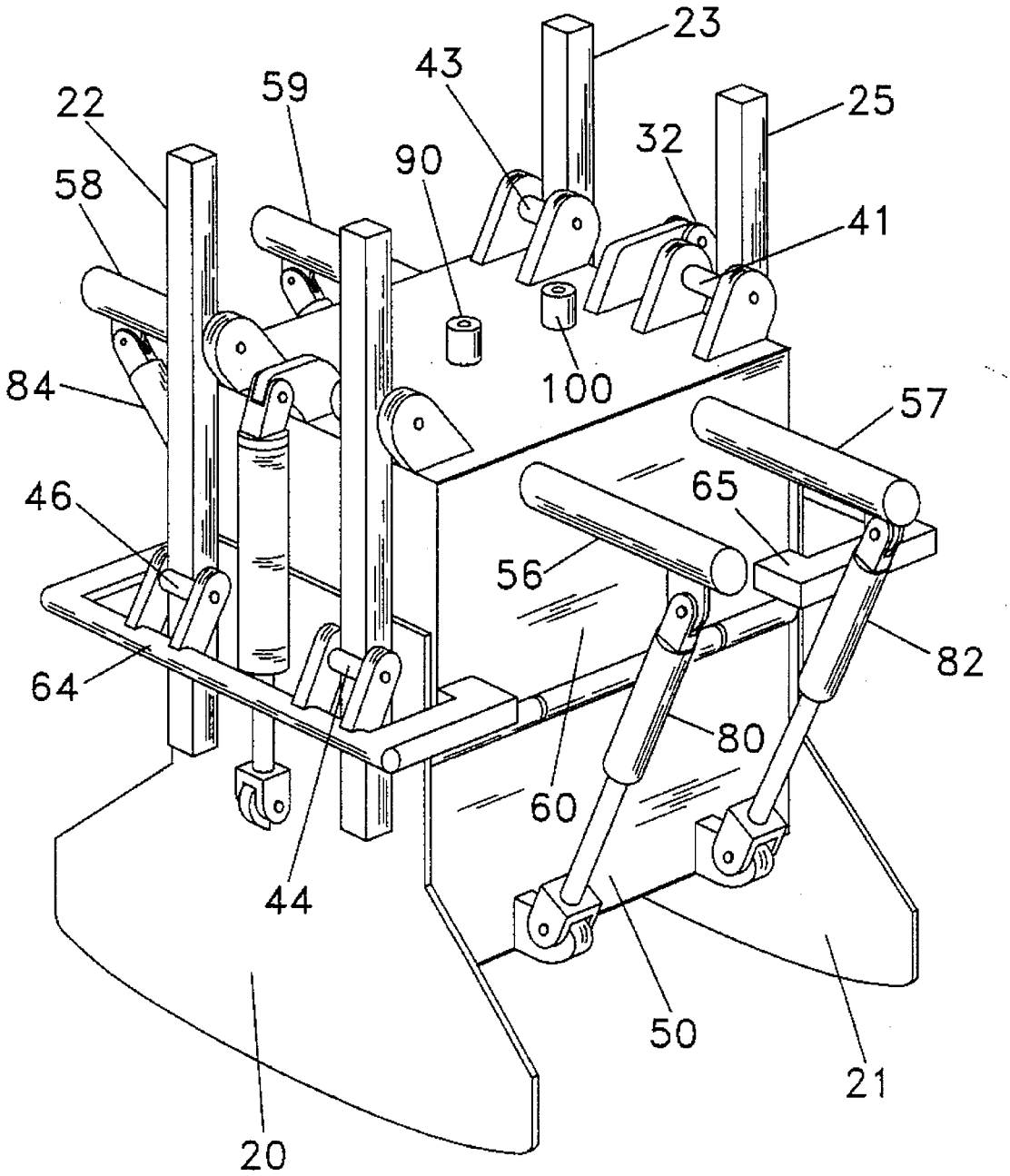
FIG. 3 is a prospective view of the dredging apparatus with the scoop buckets closed and the silt curtains deployed.

FIG. 3 illustrates the dredging apparatus in perspective view. As seen in FIG. 3, the scoop buckets 52 and 50 are in the closed position and silt curtains 20 and 21 are in the fully deployed position.

Referring again to FIG. 1, actuator support members 56, 57, 58, and 59 can be seen extending from opposite sides of the soil receiver chamber 60. In this embodiment two hydraulic linear actuators per side are employed for effecting the rotational movement of the scoop buckets 50 and 52. This dredging apparatus can be built in a variety of sizes. Small units may only employ one hydraulic linear actuator per side. Large units may employ several hydraulic linear actuators per side.

Still referring to FIG. 1, the silt curtain guide members 22 and 24 are affixed to the silt curtain plate 20 and serve to guide the motion of silt curtain plate 20 as it translates from the retracted position shown in this view to the fully deployed position as seen in FIG. 2. The guide members 22 and 24 also serve to hold the silt curtain 20 in tight sliding contact with the end plates of the scoop buckets 50 and 52 and the ends of the soil receiver 60.

Figure 4:
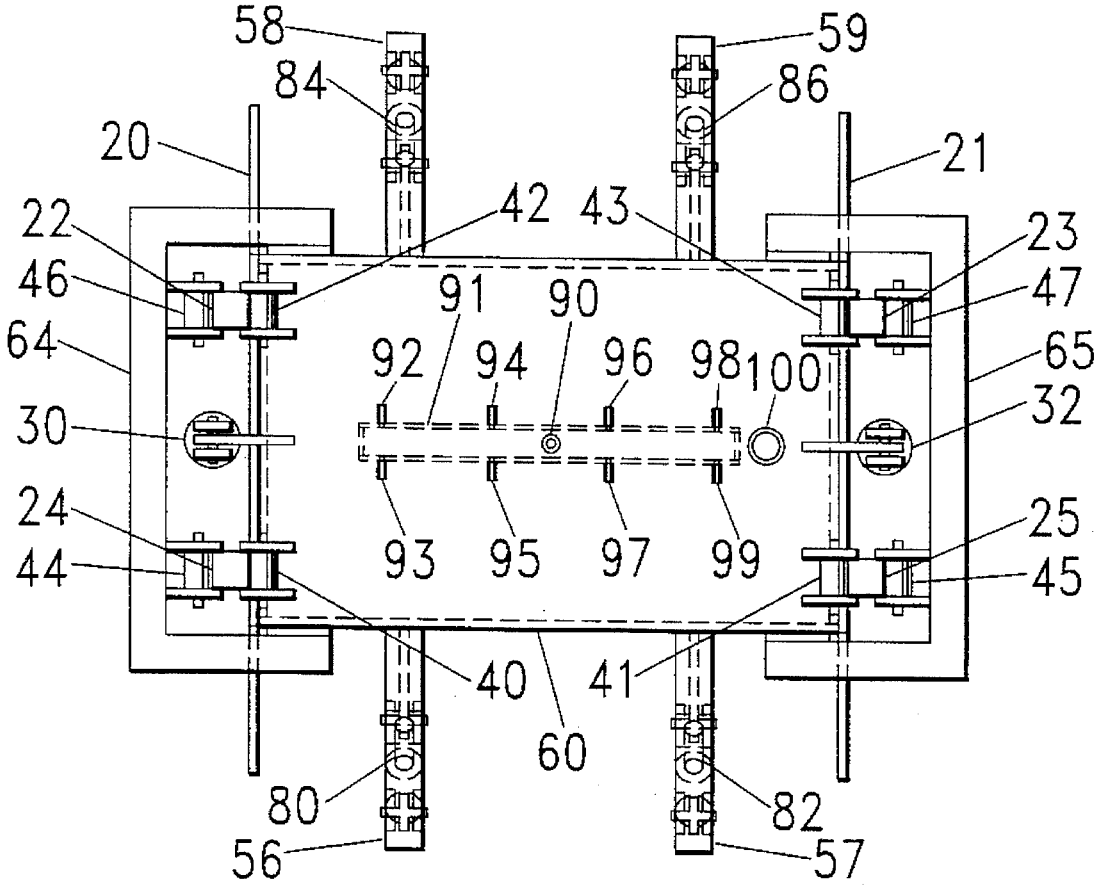
FIG. 4 is a plan view of the dredging apparatus.

Now referring to FIG. 4, it can be seen that there are silt curtain guide members 23 and 25 at the opposite end of the apparatus which serve a corresponding function in that they guide the motion of silt curtain plate 21.

Referring again to FIG. 1. In this embodiment the guide members 22, 23, 24, and 25 are elongated square tubes however rectangular tubes, round tubes or other elongated members could serve the same function.

Again referring to FIG. 1 it can be seen that the "U" shaped roller support member 64 extends from the sides of the soil receiver 60 and serves to support rollers 44 and 46. The length of rollers 44 and 46 correspond to the width of the silt curtain guide members 22 and 24. Referring again to FIG. 4, the length of rollers 45 and 47 correspond to the width of the silt curtain guide members 23 and 25.

Now referring again to FIG. 4 it can be seen that there is a "U" shaped support member 65 which extends from the sides of the soil receiver 60 and serves to support rollers 45 and 47. The length of rollers 45 and 47 corresponds to the width of the silt curtain guide members 23 and 25.

Again referring to FIG. 1 and FIG. 4 it can be seen that rollers 40, 41, 42, and 43 are bracket mounted on the upper surface of soil receiver chamber 60. The length of rollers 40 and 42 correspond to the width of the silt curtain guide members 22 and 24 and the length of rollers 41 and 43 correspond to the width of the silt curtain guide members 23 and 25.

Referring again to FIG. 1, FIG. 2 and FIG. 4, it can be seen that the position of rollers 40, 41, 42, 43, 44, 45, 46 and 47 serve to maintain the vertical alignment of silt curtain guide members 22, 23, 24 and 25 and thus keep silt curtains 20 and 21 in sliding contact against the end surfaces of soil receiver chamber 60 and the end surfaces of scoop buckets 50 and 52. In this embodiment of the dredging apparatus rollers 40, 41, 42, 43, 44, 45, 46 and 47 have been incorporated to facilitating the motion and alignment of the silt curtain guide members 22, 23,. It can be appreciated that low friction bearing pads can be substituted as a guidance means without adversely effecting the function of the silt curtain system.

Figure 5:
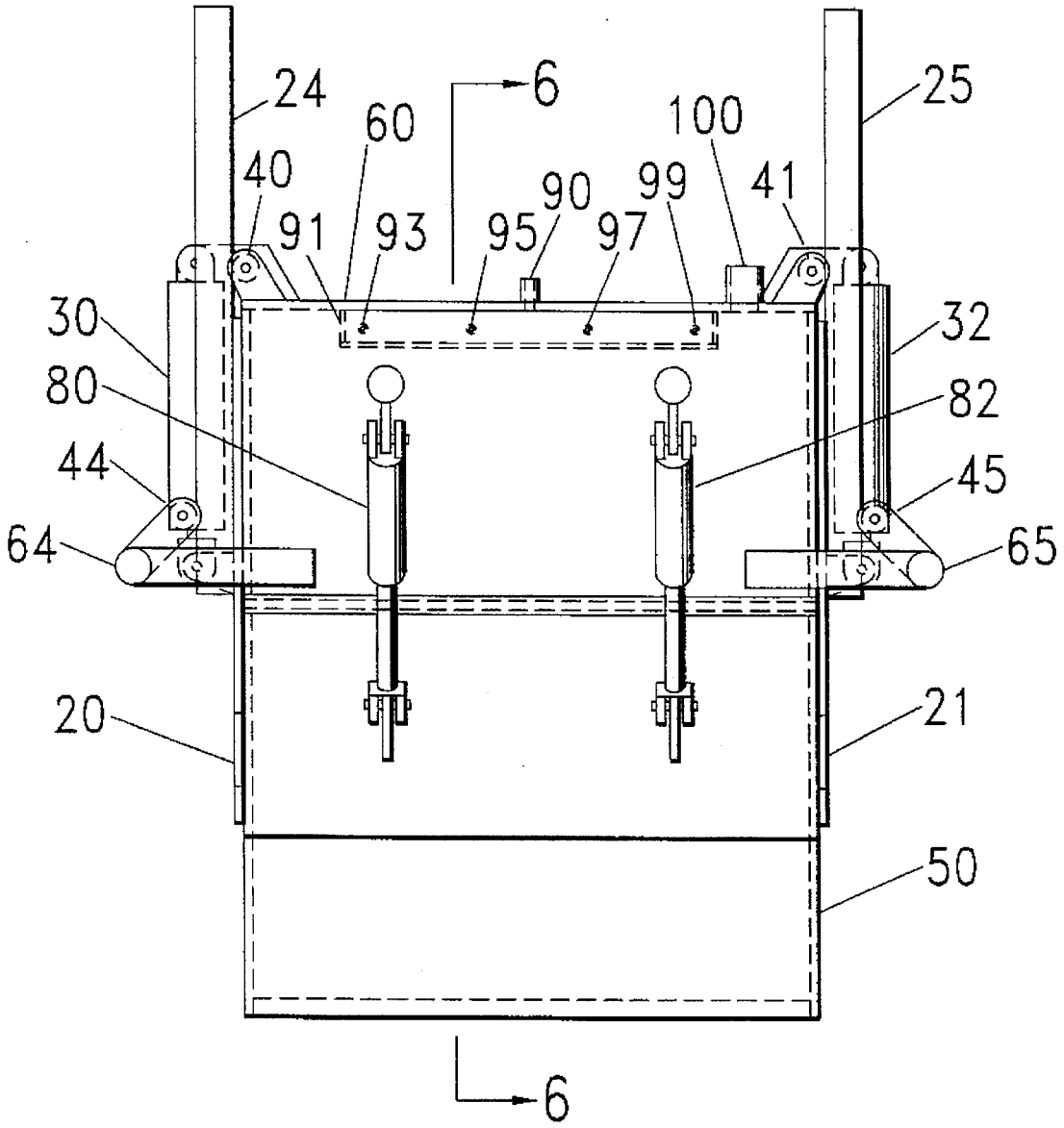
FIG. 5 is a side elevation of the dredging apparatus

Referring now to FIG. 4 and FIG. 5, it can be seen that a jet water supply hose connection fitting 90 is in communication with the jet water manifold 91 and that introducing jet water into said hose connection fitting 90 would distribute said jet water to jet nozzles 92, 93, 94, 95, 96, 97, 98 and 99. It can be appreciated that jet water distributed thus would tend to wash the inner surfaces of soil receiver chamber 60 and aid in the removal of adhesive soils.

Referring again to FIG. 4 and FIG. 5, it can be seen that an air supply hose connection fitting 100 is in communication with the interior of soil receiver chamber 60. It can be appreciated that supplying pressurized air to the soil receiver chamber 60 via air supply hose connection fitting 100 will lower the air/water interface within soil receiver chamber 60 as the volume of pressurized air increases.

Figure 6:
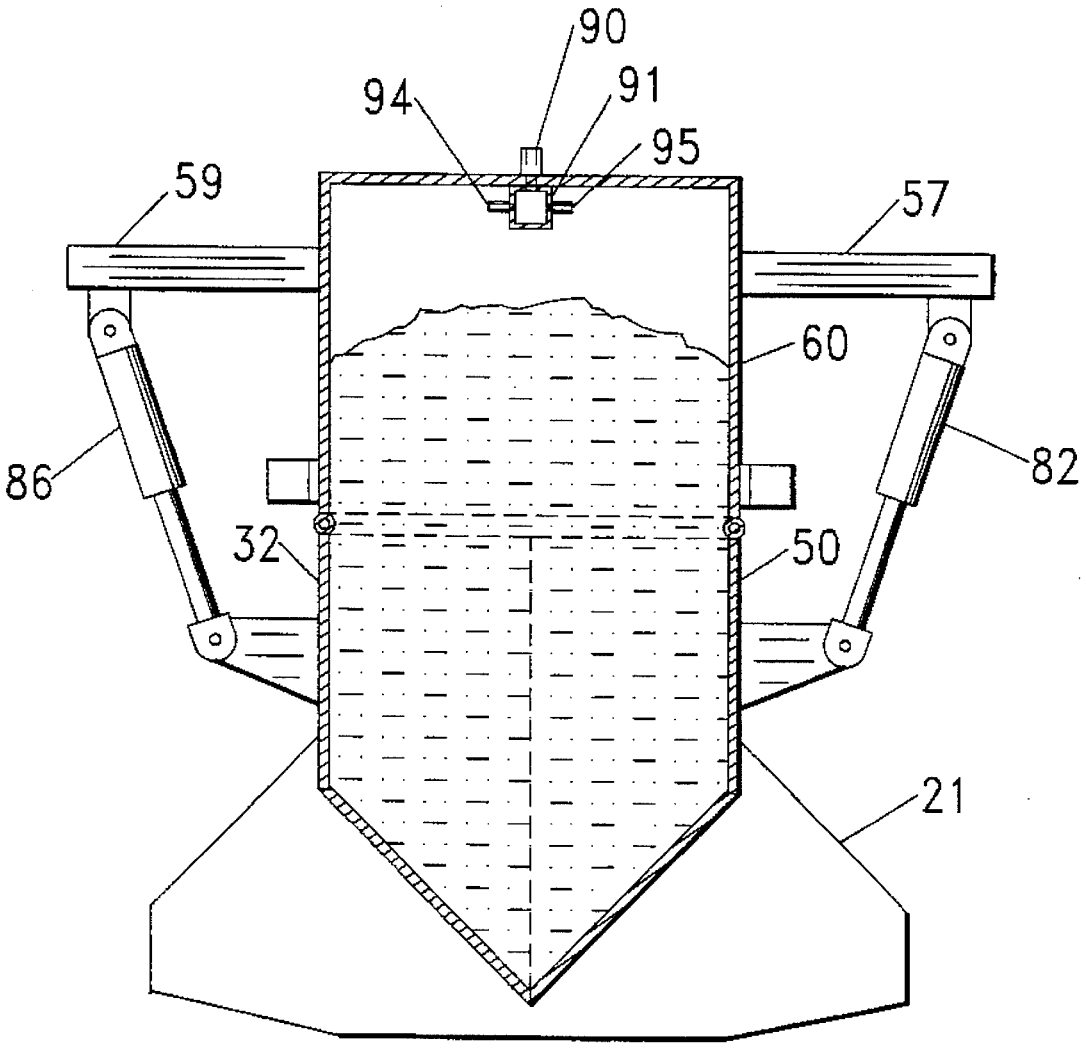
FIG. 6 an end elevation of the dredging apparatus.

Referring now to FIG. 6, it can be seen that the soil captured by scoop buckets 50 and 52 will cause a portion of the soil to move into the air-void in soil receiver 60. It can be appreciated that the air-void provides space for the incoming soil and thus eliminates the expulsion of contaminated water.

Figure 7:
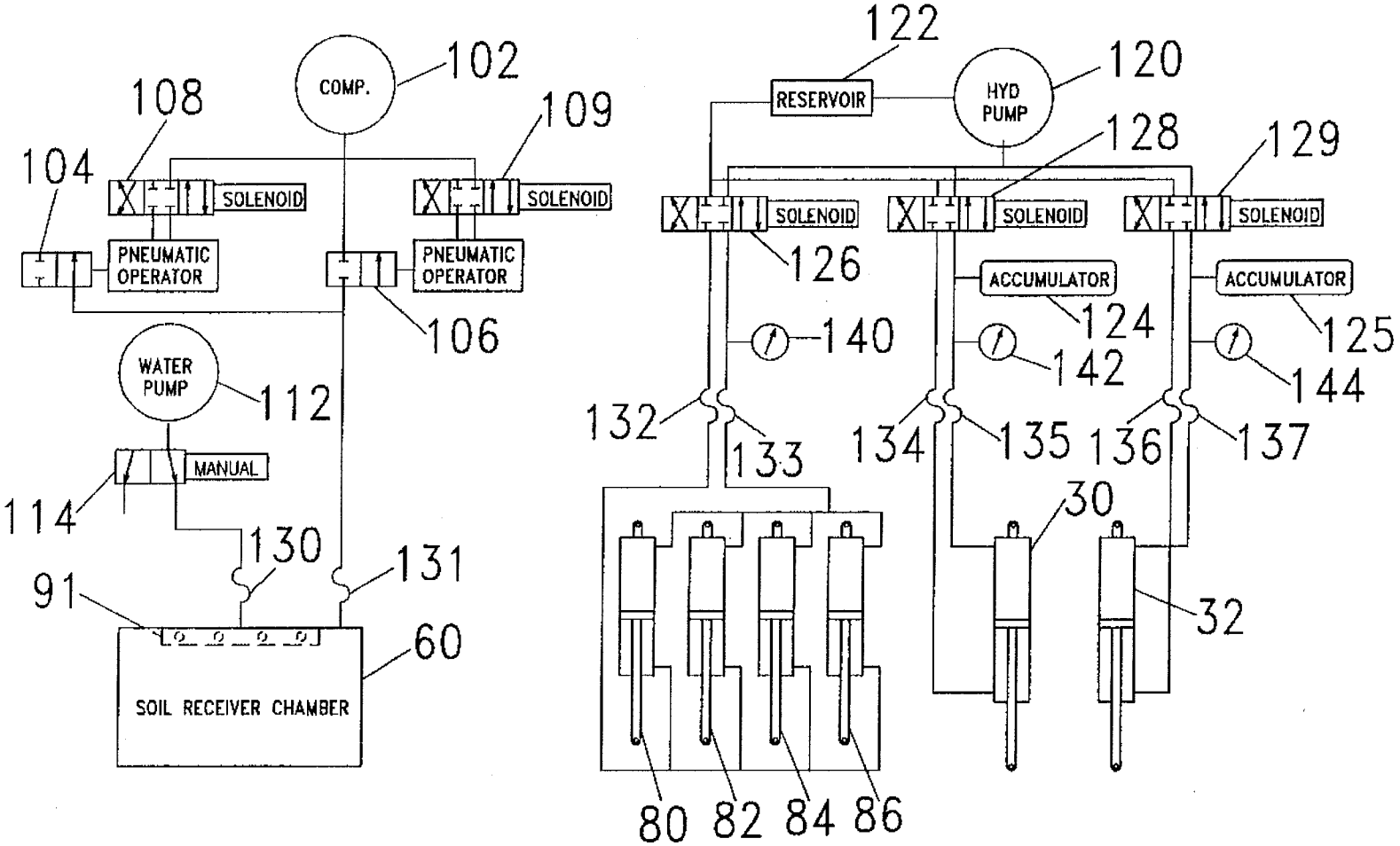
FIG. 7 is a schematic view of the control system.

FIG. 7 illustrates schematically the prime mover power sources and the system control operators. The hydraulic pump 120 generates the hydraulic power that operates the scoop bucket hydraulic linear actuators, 80, 82, 84, 86, and the silt curtain hydraulic linear actuators 30 and 32.

Again referring to FIG. 7, the solenoid operated hydraulic control valve 126 directs hydraulic power to the scoop bucket hydraulic linear actuators, 80, 82, 84, and 86 to operate the closure and opening functions of the scoop buckets. The hydraulic power is transmitted from the vessel mounted hydraulic system to the apparatus via hydraulic supply hose 133 and hydraulic return hose 132. It can be appreciated that the solenoid operated hydraulic control valve 126 could be replaced by a manually operated hydraulic control valve without changing the functionality of the system.

Again referring to FIG. 7, the solenoid operated hydraulic control valves 128 and 129 direct hydraulic power to the silt curtain deployment hydraulic linear actuators, 30, and 32 to operate the lowering and raising functions of the silt curtains. The hydraulic power is transmitted from the vessel mounted hydraulic system to the apparatus via hydraulic supply hoses 135 and 137, and hydraulic return hoses 134 and 136. Accumulators, 124 and 125 are incorporated in the circuitry to provide a reserve of hydraulic power to the silt curtain deployment hydraulic linear actuators, 30 and 32 so that the silt curtains may lower further after solenoid operated hydraulic control valves 128 and 129 have been set in the closed position. It can be appreciated that the solenoid operated hydraulic control valves 128 and 129 could be replaced by manually operated hydraulic control valves without changing the functionality of the system.

Again referring to FIG. 7, the air compressor 102 provides pressurized air for lowering the air/water interface in soil receiver chamber 60. The supply of air to the soil receiver chamber 60 is controlled by the pneumatic operated valve 106 which is in turn controlled by the solenoid operated air control valve 109. The pressurized air is transmitted from the vessel mounted air compressor 102 to the soil receiver chamber 60 via the air hose 131. Venting pressurized air from the soil receiver chamber 60 is controlled by the pneumatic operated valve 104 which is in turn controlled by the solenoid operated air control valve 108. The pressurized air is transmitted from the soil receiver chamber 60 via the air hose 131. It can be appreciated that the pneumatic operated valves 104, 106 and the solenoid operated air control valves 108 and 109 could be replaced by manually operated air control valves without changing the functionality of the system.

Again referring to FIG. 7, the water pump 112 provides pressurized water to the jet water manifold 91 for washing the interior of soil receiver chamber 60. The pressurized water is controlled by the manual control valve 114 which directs pressurized water from the vessel mounted water pump 112 to the jet water manifold 91 via the water hose 130. The manual control valve 114 also serves to divert pressurized water over the side of the vessel when water is not required so that the water pump 112 may be run continuously during operations.

OPERATION OF THE INVENTION

The primary application of this dredging apparatus lies in the retrieval of contaminated marine sediments and thus this operation will be discussed first.

This apparatus can be utilized aboard a vessel of opportunity such as a barge with a handling device such as a crane or back-hoe. Attaching the dredging apparatus to the crane or back-hoe and using same to handle the apparatus is an ordinary engineering task and known art and thus will not be discussed herein. For the purposes of clarity and simplicity, a crane will be considered as the handling device in the following discussion.

Referring now to FIG. 1. The dredging apparatus is lowered by the crane to the immediate vicinity of the bottom with scoop buckets 50 and 52 in the full open position and silt curtains 20 and 21 in the fully retracted position as seen in FIG. 1.

Referring now to FIG. 1 and FIG. 7, the solenoid operated control valve 109 is actuated which in turn actuates the pneumatic operated air supply valve 106 which allows pressurized air generated by compressor 102 to flow to the dredging apparatus via air hose 131. This situation is maintained until air bubbles begin to flow out from the lowermost edge of the silt curtains 20 and 21. Upon sight of the bubbles, solenoid operated control valve 109 is de-activated thus securing the flow of pressurized air. At this point the air/water interface is nominally at the level of the lowermost edge of the silt curtains 20 and 21.

Referring again to FIG. 1 and FIG. 7. In certain instances a flow of air bubbles may be undesirable and thus the air/water interface must be set at a level above the lowermost edge of the silt curtains 20 and 21. In this situation, the flow of air entering the dredging apparatus is maintained for a pre-determined period of time. With a known volumetric flow output of the compressor 102, the required time interval to lower the air/water interface to a desired level can be determined by ordinary engineering computation methods.

Referring now to FIG. 1, FIG. 2, FIG. 3 and FIG. 7, the dredging apparatus is lowered into the bottom soil until resistance to further penetration is encountered. The silt curtains 20 and 21 are then lowered to the full deployment position as seen in FIG. 2 or until resistance is encountered by activating solenoid operated hydraulic control valves 128 and 129 which direct hydraulic power from hydraulic pump 120 to silt curtain deployment hydraulic linear actuators 30 and 32 via hydraulic hoses 134, 135, 136 and 137. The silt curtain penetration resistance is determined by monitoring hydraulic pressure gages 142 and 144. Solenoid operated hydraulic control valves 128 and 129 are de-activated when the silt curtains 20 and 21 reach penetration resistance. The scoop buckets 50 and 52 are closed as seen in FIG. 3 by activating solenoid operated hydraulic control valve 126 which directs hydraulic power from hydraulic pump 120 to scoop buck closure hydraulic actuators 80, 82, 84, and 86. Full closure of the scoop buckets 50 and 52 is determined by monitoring hydraulic pressure gage 140. Simultaneous with the operation of scoop buckets 50 and 52, the solenoid operated control valve 108 is actuated which in turn actuates the pneumatic operated air vent valve 104 which allows air within soil receiver chamber 60 to vent to the atmosphere via air hose 131. Venting air in this manner lowers the air pressure inside soil receiver chamber 60 to a value less than the ambient water pressure outside the soil receiver chamber 60 thus any water leakage will be into the apparatus.

Referring now to FIG. 3 and FIG. 7, the dredging apparatus is lifted off the bottom. At the point of "break-out", the hydraulic pressure gage 140 is monitored to determine if full hydraulic system pressure is maintained in the bucket closure system. A pressure drop indicates that the scoop buckets 50 and 52 are not in the fully closed position and thus the solenoid operated hydraulic control valve 126 is briefly activated to assure full closure of the scoop buckets 50 and 52.

Referring now to FIG. 1 and FIG. 7, the dredging apparatus is positioned over the vessel or container which is to receive the dredged soil and the scoop buckets 50 and 52 are brought to the full open position by as seen in FIG. 1 by activating solenoid operated hydraulic control valve 126 which directs hydraulic power from hydraulic pump 120 to scoop bucket hydraulic actuators 80, 82, 84, and 86. Simultaneous with the operation of the scoop buckets 50 and 52, silt curtains 20 and 21 are raised to the fully retracted position as seen in FIG. 1 by activating the solenoid operated hydraulic control valves 128 and 129 which direct hydraulic power from the hydraulic pump 120 to silt curtain deployment hydraulic linear actuators 30 and 32 via hydraulic hoses 134, 135, 136 and 137.

Referring now to FIG. 4, FIG. 5, FIG. 6, and FIG. 7. Some marine soils such as clay exhibit highly adhesive properties and thus may be prone to adhere to the inner wall surfaces of soil receiver 60. When this situation occurs, manual water control valve 112 is opened to direct pressurized water from water pump 112 to jet water manifold 91 and jet water nozzles 92, 93, 94, 95, 96, 97, 98, and 99 via water hose 130 thus washing the soil out of soil receiver chamber 60.

The secondary application of this dredging apparatus lies in dredging general marine soils and this operation will now be discussed hereunder.

Referring now to FIG. 1 and FIG. 7. Providing an air-void in soil receiver chamber 60 is not necessary when dredging general marine soils thus air hose 131 is disconnected from air supply hose connection fitting 100.

Referring again to FIG. 1 FIG. 2, FIG. 3 and FIG. 7. The dredging apparatus is lowered by the crane to the bottom with scoop buckets 50 and 52 in the full open position and the silt curtains 20 and 21 in the fully retracted position as seen in FIG. 1. The dredging apparatus is lowered into the bottom soil until resistance to further penetration is encountered. The silt curtains 20 and 21 are then lowered to the full deployment position as seen in FIG. 2 or until resistance is encountered by activating solenoid operated hydraulic control valves 128 and 129 which direct hydraulic power from hydraulic pump 120 to silt curtain deployment hydraulic linear actuators 30 and 32 via hydraulic hoses 134, 135, 136 and 137. The silt curtain penetration resistance is determined by monitoring hydraulic pressure gages 142 and 144. Solenoid operated hydraulic control valves 128 and 129 are de-activated when the silt curtains 20 and 21 reach penetration resistance. The scoop buckets 50 and 52 are closed as seen in FIG. 3 by activating solenoid operated hydraulic control valve 126 which directs hydraulic power from hydraulic pump 120 to scoop buck closure hydraulic actuators 80, 82, 84, and 86. Full closure of the scoop buckets 50 and 52 is determined by monitoring hydraulic pressure gage 140.

Referring now to FIG. 3 and FIG. 7, the dredging apparatus is lifted off the bottom. At the point of "break-out," the hydraulic pressure gage 140 is monitored to determine if full hydraulic system pressure is maintained in the bucket closure system. A pressure drop indicates that the scoop buckets 50 and 52 are not in the fully closed position and thus solenoid operated hydraulic control valve 126 is briefly activated to assure full closure of the scoop buckets 50 and 52.

Referring now to FIG. 1 and FIG. 7, the dredging apparatus is positioned over the vessel or container which is to receive the dredged soil and the scoop buckets 50 and 52 are brought to the full open position by as seen in FIG. 1 by activating solenoid operated hydraulic control valve 126 which directs hydraulic power from hydraulic pump 120 to scoop bucket hydraulic actuators 80, 82, 84, and 86. Simultaneous with the operation of scoop buckets 50 and 52, silt curtains 20 and 21 are raised to the fully retracted position as seen in FIG. 1 by activating solenoid operated hydraulic control valves 128 and 129 which direct hydraulic power from hydraulic pump 120 to silt curtain deployment hydraulic linear actuators 30 and 32 via hydraulic hoses 134, 135, 136 and 137.

CONCLUSION, RAMIFICATIONS AND SCOPE OF INVENTION

The reader can see that my invention is a new dredging apparatus and method of retrieving contaminated marine sediments that offers important technical and environmental advantages over conventional dredging apparatus and techniques. My invention meets the objective of effectively and economically retrieving contaminated marine sediments in a manner that minimizes the possibility of further damage to the marine environment.

There are important ramifications to my invention in that the Federal Government is soon to issue guidelines for the remediation of contaminated bodies of water. It is anticipated that most bodies of water that have an adjacent industrial site on the shore will require a remediation effort. Many marine locations have been identified that contain hazardous contaminants that must be contained during the removal process.

Maintenance dredging of harbors and waterways is an ongoing process. It is anticipated that, in most instances, the new Federal guidelines will require a portion of the project to be designated as contaminated sediments. In general, an upper layer of contaminated sediments will have to be removed before the clean soil beneath it can be excavated. My dredging apparatus offers a unique advantage in that it can be employed to remove the contaminated sediments and also to excavate the clean soil of the lower strata.

In conclusion, my dredging apparatus provides a safe, effective, and economical means of improving the marine environment that will find a ready and growing market.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims including the full range of equivalency to which each element thereof is entitled.

What is claimed is:

1. A marine dredging device comprising:

a soil receiver chamber;

scoop buckets hinge connected to said soil receiver chamber;

actuation means to rotate said scoop buckets in relation to said soil receiver chamber, translatable silt curtains adjacent to lateral extremities of the scoop buckets serving to block an aperture between said scoop buckets.

2. A marine dredging device as described in claim 1 wherein the actuation means is comprised of:

a hydraulic pressure source;

hydraulic linear actuators interconnected between said soil receiver chamber and said scoop buckets so as to impart rotary motion of said scoop buckets relative to said soil receiver chamber;

means to control flow of hydraulic oil to said hydraulic linear actuators.

3. A marine dredging device as described in claim 1 with the inclusion of:

actuation means for translating said curtains relative to said scoop buckets.

4. The method of operating the apparatus of claim 3 whereby:

the device is lowered to the bottom of a body of water with the scoop buckets in a full open position and the silt curtains in a fully retracted position;

the device is thence lowered into the soil;

said silt curtains are thence deployed to make contact with said water bottom;

said scoop buckets are thence closed capturing a portion of soil;

said device is retrieved from the water and said soil is discharged by opening said scoop buckets.

5. A marine dredging device as described in claim 3 wherein the translatable silt curtains may be operated independently of each other.

6. A marine dredging device as described in claim 1 with the inclusion of:

a pressurized water source;

piping to transport said pressurized water to the apparatus;

a manifold and water jet nozzles configured so as to direct said pressurized water to device.

7. A marine dredging device as described in claim 1 with the inclusion of:

translatable curtains adjacent to the lateral extremities of the scoop buckets serving to block the aperture between said scoop buckets;

actuation means for translating said curtains relative to said scoop buckets.

air pressurization means for creating an air-void in the soil receiver chamber.

8. The method of operating the device of claim 7 whereby:

the device is lowered to the bottom of a body of water with the scoop buckets in a full open position and the silt curtains in a fully retracted position;

pressurized air is introduced into the soil receiver chamber in sufficient quantity to lower the air/water interface to a predetermined level;

the device is thence lowered into the soil;

said silt curtains are thence lowered to make contact with said water bottom;

said scoop buckets are thence closed capturing a portion of soil;

said device is retrieved from the water and the soil is discharged by opening the scoop buckets.

9. The method of operating the device of claim 7 whereby:

the device is lowered to the bottom of a body of water with the scoop buckets in a full open position and the silt curtains in a fully retracted position;

pressurized air is introduced into the soil receiver chamber in sufficient quantity to lower the air/water interface to a predetermined level;

the device is thence lowered into the soil;

said silt curtains are thence lowered to make contact with said water bottom;

said scoop buckets are thence closed capturing a portion of soil;

simultaneous with closing said scoop buckets, air is vented from said soil receiver chamber;

said device is retrieved from the water and the soil is discharged by opening the scoop buckets.

10. The method of operating the device of claim 9 whereby:

the device is lowered to the bottom of a body of water;

pressurized air is introduced into the device in sufficient quantity to lower the air/water interface to a predetermined level;

the device is thence lowered into the soil and actuated to capture a portion of soil;

said device is retrieved from the water and the soil is discharged.

11. The method of operating the device of claim 1 whereby:

the device is lowered to the bottom of a body of water with the scoop buckets in a full open position;

the device is thence lowered into the soil;

said scoop buckets are thence closed capturing a portion of soil;

said device is retrieved from the water and the soil is discharged by opening said scoop buckets.

12. A marine dredging device comprising:

a soil receiver chamber;

scoop buckets hinge connected to said soil receiver chamber;

actuation means to rotate said scoop buckets in relation to said soil receiver chamber;

air pressurization means for creating an air-void in the soil receiver chamber.

13. The method of operating the apparatus of claim 12 whereby:

the device is lowered to the bottom of a body of water with the scoop buckets in a full open position;

pressurized air is introduced into the soil receiver chamber in sufficient quantity to lower the air/water interface to a predetermined level;

the device is thence lowered into the soil;

said scoop buckets are thence closed capturing a portion of soil;

said device is retrieved from the water and the soil is discharged by opening said scoop buckets.

14. The method of operating the apparatus of claim 12 whereby:

the device is lowered to the bottom of a body of water with the scoop buckets in a full open position;

pressurized air is introduced into the soil receiver chamber in sufficient quantity to lower the air/water interface to a predetermined level;

the device is thence lowered into the soil;

said scoop buckets are thence closed capturing a portion of soil;

simultaneous with closing said scoop buckets, air is vented from said soil receiver chamber;

said device is retrieved from the water and the soil is discharged by opening said scoop buckets.

15. A method of dredging marine sediments comprising the following procedures:

lowering a dredging apparatus to the bottom of a body of water;

displacing water in an open bottom chamber with pressurized air;

cutting and capturing a portion of soil;

introducing said soil into said open bottom chamber;

retrieving said dredging apparatus from the water;

disposing of said soil.

16. The method described in claim 15 with the inclusion of the further step:

deploying a silt curtain to block and seal apertures through which soil may extrude during the actuation of the dredge apparatus.

* * * * *